US005964345A

United States Patent [19]

Gamberini

[11] Patent Number: 5,964,345

[45] **Date of Patent: *Oct. 12, 1999**

[54] CIGARETTE PACKET WITH A HINGED LID

[75] Inventor: Antonio Gamberini, Bologna, Italy

[73] Assignee: G. D S.p.A., Bologna, Italy

[ * ] Notice: This patent issued on a continued prosecution application filed under 37 CFR 1.53(d), and is subject to the twenty year patent term provisions of 35 U.S.C. 154(a)(2).

[21] Appl. No.: 08/907,908

[22] Filed: Aug. 11, 1997

Related U.S. Application Data

[63] Continuation-in-part of application No. 08/551,749, Nov. 7, 1995, abandoned.

[30] Foreign Application Priority Data

Nov. 7, 1994 [IT] Italy ..... B094A00483

[51] Int. Cl.[6] ..... A24F 15/00

[52] U.S. Cl. ..... 206/259; 206/268; 206/273

[58] Field of Search ..... 206/259, 264, 206/268, 273, 271; 229/160.1

[56] References Cited

U.S. PATENT DOCUMENTS

| | | |
|---|---|---|
| 777,222 | 12/1904 | Pratt . |
| 3,708,108 | 1/1973 | Rosenburg, Jr. . |
| 3,807,622 | 4/1974 | Belcher et al. . |
| 3,967,730 | 7/1976 | Driscoll et al. . |
| 4,216,898 | 8/1980 | Davies . |
| 4,303,154 | 12/1981 | Hicks . |
| 4,732,276 | 3/1988 | Knecht . |
| 4,753,383 | 6/1988 | Focke et al. . |
| 4,771,882 | 9/1988 | Lowe et al. . |
| 5,129,513 | 7/1992 | David et al. . |
| 5,150,720 | 9/1992 | Focke et al. . |
| 5,158,664 | 10/1992 | Colgan et al. . |
| 5,207,322 | 5/1993 | Focke et al. . |
| 5,439,105 | 8/1995 | Focke . |
| 5,526,559 | 6/1996 | Fleenor et al. . |

FOREIGN PATENT DOCUMENTS

| | | |
|---|---|---|
| 583 756 | 9/1933 | Germany . |
| 23 34 190 | 1/1975 | Germany . |
| 28 06 77 | 11/1977 | Germany . |
| 37 13 612 | 11/1988 | Germany . |

*Primary Examiner*—Paul T. Sewell
*Assistant Examiner*—Nhan T. Lam
*Attorney, Agent, or Firm*—Pillsbury Madison & Sutro LLP

[57] ABSTRACT

The typical rigid cigarette packet consists of a box-like container with one open top end that can be exposed and closed by rotating a lid hinged to a rear edge of the container; the contents of the packet are restrained by a separate "U"-shaped frame element of which a first portion is anchored to the container and a second portion projects through the open top end and into the closed lid. To advantage, a front section of the first portion of the frame element incorporates a set of transverse stiffening ribs near the open top end of the container.

6 Claims, 3 Drawing Sheets

CIGARETTE PACKET WITH A HINGED LID

This application is a CIP of Ser. No. 08/551,749 filed on Nov. 7, 1995, now abandoned.

BACKGROUND OF THE INVENTION

The present invention relates to a cigarette packet having a hinged lid.

In particular, the present invention relates to a cigarette packet of substantially rigid embodiment, typically comprising a container box having a predominating longitudinal axis, having a front panel, a rear panel and two side panels, disposed parallel to the longitudinal axis, and a bottom end panel. The container box includes a body which is openable by rotationally raising at its top end, a lid which is exclusively associated with the rear panel of the body of the container box, by a hinge. The lid is capable of movement in relation to the body between an open position, in which the top end of the container box body is open, and a closed position, in which the top end is concealed by a corresponding open bottom end of the lid. The packet further includes a frame element having a front section, wherein a first portion of the front section of the frame element is located internally of the container and disposed in contact with at least a part of the front panel of the container, and a second portion of the front section of the frame element projects from the open top end of the container. The second portion, and in particular the front section thereof, necessarily is or comes in direct contact with the hinged lid when the hinged lid is moved from or into the closed position with relation to the container box body.

Conventional cigarette packets of the type outlined above are fashioned normally from blanks, i.e. flat die-cuts of cardboard or similar material, of which the single thickness has been reduced further and further over time for obvious reasons of economy. Recently, such materials have become so thin that an assembled packet can no longer even be guaranteed to retain a stable shape in normal use. It has been found with packets of more recent manufacture, in particular, that the simple operation of opening or closing the packet by moving the lid can sometimes cause the front panel of the container, together with the front section of the frame element being arranged in the container such as to be in contact with at least a part of the front panel of the container, to buckle outwards permanently or at least for the time period when the container remains pressed at its side panels, so that difficulty is experienced when opening or closing the lid.

Furthermore, there is known from U.S. Pat. No. 3,708,108 a rigid cigarette packet having a hinged lid, wherein the container of the packet is double-walled throughout its four sides and made from a one-piece blank having eight wall panels and a terminal glue flap. All of the eight panels being of approximately the same height, making a slight allowance for proper fitting of the inner structure within the outer one. The surface of the inner front panel is provided with a series of transverse debossed score lines arranged at determined intervals over nearly the complete longitudinal extent of the inner front panel for structural reinforcement of the same. The lid is connected with the rear panel of the container box body by a hinge, and is connected with the outer front and side panels of the container box body by perforated tear lines. In order to be able to open the package, the perforated tear lines have to be burst, by pressing, using one's finger, against the corresponding front and side panels of the closed lid for separating the lid in its closed position from the corresponding front and side panels of the container box body.

U.S. Pat. No. 3,708,108 does not refer to a packet having a reduced amount of material, in particular in view of the resulting complete thickness of the respective panels of the folded container, and in view of the number of panels necessary to form the container, and also in view of the longitudinal and transversal extents of the respective inner panels. In particular, this prior art document does not refer to a frame element having a reduced amount of material. There is also not disclosed in U.S. Pat. No. 3,708,108 a packet in which the effective connection between the lid and the container box body is exclusively obtained by means of a hinge provided between the rear panel of the lid and the rear panel of the container box body. Finally, the above-cited document does not refer to a packet which is able to prevent effectively that the portion of the inner front panel which projects from the outer front panel of the container can buckle outwards and consequently hinder an easy and correct closing or opening of the hinged lid with relation to the container box body.

The general object of the present invention is to provide a packet having a frame element, wherein the packet is provided with a lid which is materially associated with the container only by means of a hinge between the rear panel of the lid and the rear panel of the container box body, and the packet with the frame element is fashioned from particularly thin sheet material, and the amount of material for the container and the frame element is possibly reduced, and the frame element is in contact with the open top end of the container, and the packet yet remains unaffected by the drawbacks in question.

It is another object of the present invention to provide a packet having a hinged lid and a frame element, and the frame element not being a component of a corresponding packet blank but a separate and independent element, wherein the second portion of the front panel of the frame element, i.e. the portion that projects from the open top end of the container box body, does not buckle outwards during normal use so as to prevent an easy and/or correct closing and opening of the hinged lid with relation to the container box body.

It is yet another object of the present invention to provide a packet having a hinged lid and a frame element, and the frame element not being a component of a corresponding packet blank but a separate and independent element, wherein the front panel of the container and the second portion of the front panel of the frame element, i.e. the portion that projects from the open top end of the container box body, does not buckle inwards during normal use so as to prevent a correct and concealed closing of the hinged lid with relates to the container box body, in particular with relation to the open top end of the front panel of the container and to the projecting portion of the front panel of the frame element.

SUMMARY OF THE INVENTION

The stated general object is realized in a cigarette packet having hinged lid according to the invention.

The packet is of the type that comprises a container box having a predominating longitudinal axis, the container box exhibiting a front panel, a rear panel and two side panels, disposed parallel to the aforesaid longitudinal axis, and a bottom end panel, and the container box including a body having an open top end; a lid being associated hingedly with the rear panel of the container box body and having an open bottom end, the hinged lid being capable of rotational movement in relation to the container box body such that the open bottom end is distanced from the open top end or that the open bottom end is positioned in alignment with the open top end; a frame element comprising a front section having a first portion, located internally of the container box and disposed in contact with the inside face of the front panel, and a second portion projecting from the container box body by way of the open top end. The essential feature of the packet disclosed is that it also comprises a plurality of transverse stiffening elements defining a stiffening zone associated with a longitudinally limited upper part of the front panel near the open top end, wherein the function of the stiffening zone is to prevent the open top end of the front panel of the container box and the second portion of the frame element from collapsing transversely inward and/or outward during normal use.

In a preferred embodiment of the packet described above, the stiffening elements are constituted by ribs, which are disposed transversely to the longitudinal axis of the container box and formed advantageously on part of a forward-most portion of a U-shaped frame element which is a separate element with relates to the packet and located internally of the front panel near the open top end of the container box body.

BRIEF DESCRIPTION OF THE DRAWINGS

The invention will now be described in detail, by way of example, with the aid of the accompanying drawings, in which.

DETAILED DESCRIPTION OF THE PREFERRED EMBODIMENTS

Figure 2:
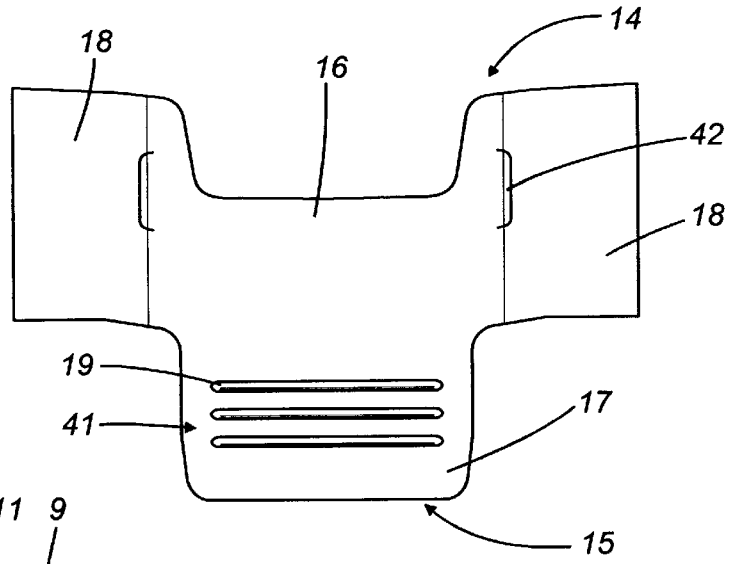
FIG. 2 illustrates the separate frame element for the packet of FIG. 1, developed (i.e. in a flat, non-folded condition) and viewed in plan.

With reference to the drawings, and according to a preferred embodiment of the present invention, 1 denotes a rigid packet serving to accommodate a group of cigarettes (not illustrated), which comprises a container box 2, at bottom embodied essentially as a box body having an open top end 3, the container box also comprising a lid 4 uppermost, having an open bottom end 43, hinged to the container 2 and rotatable between an open position (FIG. 3), in which the open top end 3 of the container box body 2 is exposed, and a closed position (FIG. 1), in which the open top end 3 is concealed by the open bottom end 43 of the lid 4. The packet 1 is also provided with a separate and independent frame element 14 incorporated in the container box body 2 and projecting in part from the open top end 3 of the container box body 2 (see FIG. 3).

Figure 1:
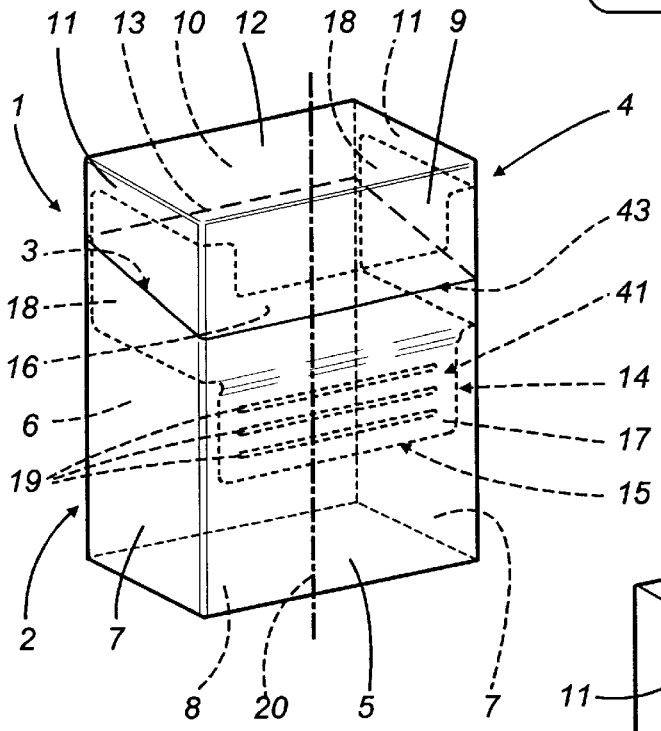
FIG. 1 illustrates a preferred embodiment of the packet according to the present invention, schematically viewed in perspective, with the hinged lid in the closed position with relation to the container box body.
Figure 3:
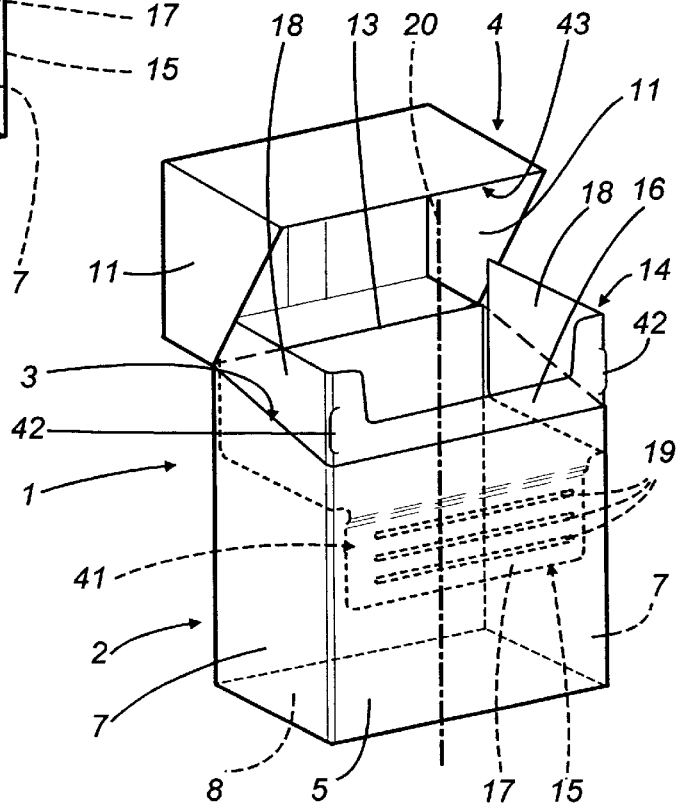
FIG. 3 illustrates the packet of FIG. 1 schematically viewed in perspective with the hinged lid in an open position with relation to the container box body.
Figure 6:
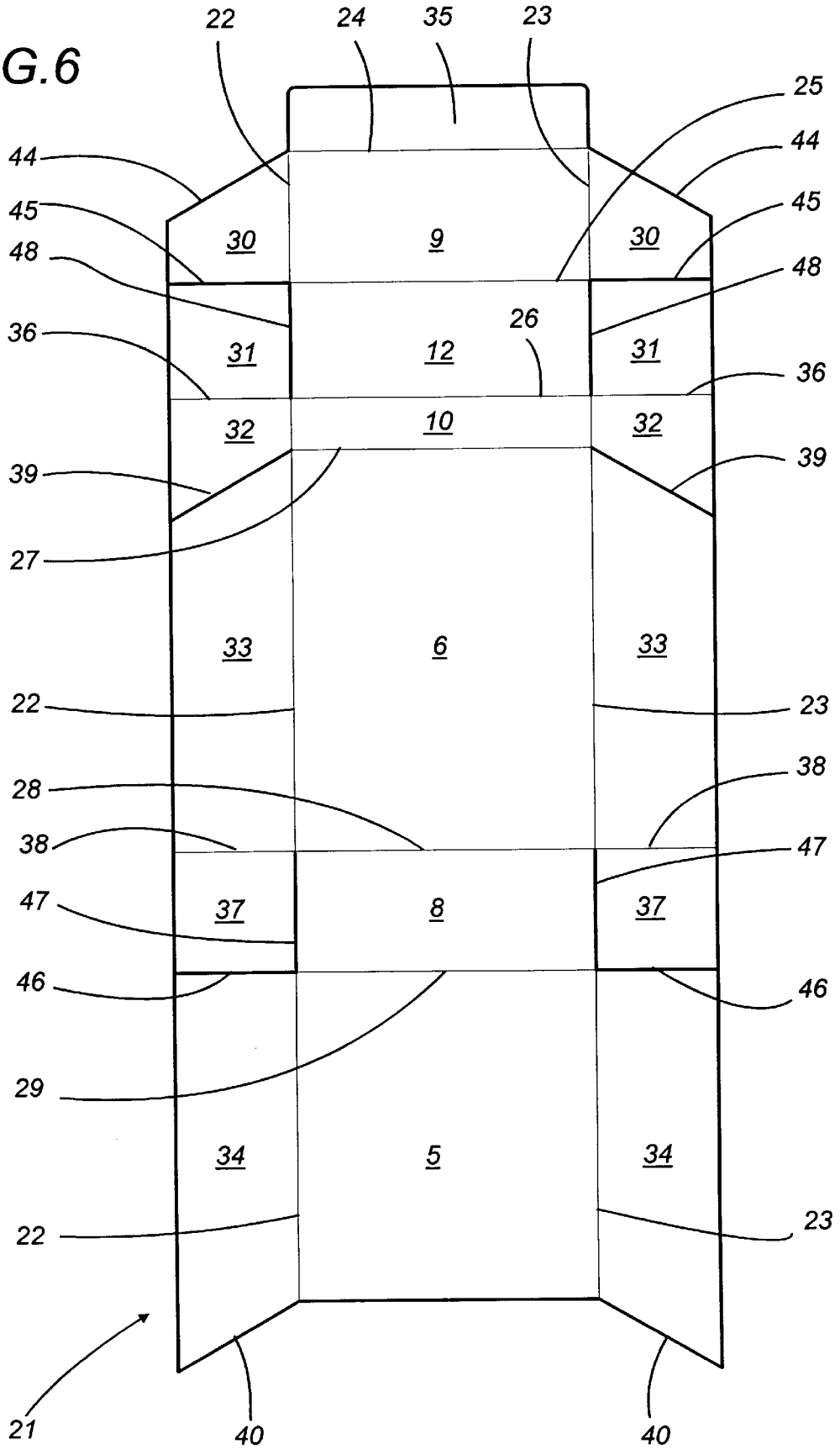
FIG. 6 illustrates in plan view a blank used to make the packet of FIGS. 1 and 3 on a reduced scale.

FIG. 6 is a plan view of a blank 21 used to make the container box body 2 and the lid 4 according to FIG. 1 and FIG. 3. The frame element 14 is a separate element (see FIG. 2) and is not formed from any part of the blank 21, hereinafter described in detail.

The blank 21 is preferably a sheet of single and constant thickness and substantially rectangular in shape. The blank 21 has a plurality of pre-weakened transversal folding lines, labelled 24 through 29, and two parallel pre-weakened lengthways folding lines 22 and 23.

With reference to the lid 4, the transversal folding lines 24 through 27 define, between lines 22 and 23, a front panel 9 which extends between lines 24 and 25; a strengthening tab 35 connected to the front panel 9 along the line 24; an end panel 12 extending between lines 25 and 26; a rear panel 10 extending between lines 26 and 27 and in this case lower in height (i.e. lesser in extent longitudinally of the container box) than panel 9.

Furthermore, relating to the container box body 2, the transversal folding lines 27 through 29 define, between lines 22 and 23, a rear panel 6 extending between lines 27 and 28; a bottom end panel 8 extending between lines 28 and 29; and a front panel 5 extending from the line 29.

The two longitudinal folding lines 22 and 23 of the blank 21 form, outside the panels 9, 10, 6 and 5, respective wings, which are labelled 30, 32, 33 and 34 in FIG. 6. The wings 32 are outside the panel 10 and have respective longitudinal extensions 31, which are joined to the wings 32 along respective pre-weakened folding lines 36. The wings 33 are outside the panel 6 and have respective lengthways extensions 37, which are joined to the wings 33 along respective pre-weakened folding lines 38.

Each of the wings 30 is externally delimited in the longitudinal direction by a respective edge 44 which is oblique, directed towards the adjacent extension 31 and parallel to the edge 39 of the respective wing 32 and to the end edge 40 of the respective wing 34. In consequence, each end edge 40 is oblique and directed away from the adjacent extension 37. The extensions 31 and 37 are rectangular in shape, wherein each extension 31 is provided with an transversal edge 45 adjacent to a respective wing 30 and a longitudinal edge 48 adjacent to the panel 12, and wherein each extension 37 is provided with an transversal edge 46 adjacent to a respective wing 34 and a longitudinal edge 47 adjacent to the panel 8.

The line 27 forms a hinge 13 (see also FIG. 3), and the wings 33 and 34, after being folded by 90° with respect to panels 6 and 5, are overlapped when the panels 5 and 6 are respectively rotated by 90° towards each other with relation to the panel 8, the wings forming the lateral or flank panels 7 of the container box body 2; the extensions 37 are folded by 90° with respect to the wings 33 and are turned with the wings 33 to bring them into contact with the internal surface of the panel 8, and to form, together with the same panel 8, the bottom end panel 8. In the same way, the wings 30 and 32 of the panels 9 and 10 are folded by 90° with respect to panels 9 and 10 and are overlapped when the panels 9 and 10 are rotated towards each other with respect to panel 12, to form the front and rear panels 9 and 10 of the lid 4; and the extensions 31 are folded by 90° with respect to the wings 32 and are turned with the wings 32 to bring them into contact with the internal surface of the panel 12 and form, together with the panel 12, the end panel 12 according to FIG. 1.

Each of the front, rear, left and right side panels 5, 6 and 7 is preferably made of a single thickness of stock material, i.e. they are made of a single blank 21 of stock material having a given and single thickness. In correspondence, also the front section 15 and the lateral portions 18 of the frame element 14 are preferably made of a single thickness of stock material, i.e. they are made of a single blank (see FIG. 2) of stock material having a given and single thickness.

The folding of the blank 21 produces only the container box body 2 and the lid 4. As mentioned above, the inner frame element 14 must be produced and folded separately and subsequently inserted and internally connected to the already folded container box body 2 in order to obtain the packet 1, as schematically illustrated in FIGS. 1 and 3.

As clearly shown in FIGS. 1 and 3, the folded container box body 2 has a front panel 5 and a rear panel 6, mutually opposed and parallel, two lateral or flank panels 7 disposed mutually parallel and perpendicular to the front and rear panels 5 and 6, and a bottom end panel 8 disposed, in this case, perpendicular to the remaining panels 5, 6 and 7.

The folded lid 4 has a front panel 9 and a rear panel 10, mutually opposed and parallel, two flank panels 11 disposed mutually parallel and perpendicular to the front and rear panels 9 and 10, and an end panel 12 disposed, in this case, perpendicular to the other four panels 9, 10 and 11. In particular, the top and bottom edges presented respectively by the rear panel 6 of the container box body 2 and by the rear panel 10 of the lid 4 are permanently and pliably associated along a crease line providing a hinge 13 about which the lid 4 can be rotated between the open and closed positions mentioned above.

As already mentioned, the packet 1 also incorporates the separate frame element 14, preferably of U shape and projecting in part from the open top end 3 of the container box body 2 and providing a front section 15 which, in turn, is composed of an upper portion 16 extending upward from behind the front panel 5 of the container box body 2 and a lower portion 17 subsequently associated rigidly with preferably only a part of the inside face of the front panel 5 of the folded container box body 2. The U-shaped frame element 14 further comprises two lateral portions 18, each in direct contact and secured to the inside face of the corresponding flank panel 7 and projecting beyond the open top end 3 into the lid 4, according to FIG. 1.

As discernible from FIG. 2, the frame element 14 provides a plurality of stiffening ribs 19 extending across the lower portion 17 of the aforementioned front section 15, transversely to a predominating longitudinal axis 20 of the packet 1, preferably at an angle of 90° with relates to the axis 20 (see FIG. 1). The function of the stiffening ribs 19 is to add rigidity both to the front section 15 of the frame element, 14 and to the front panel 5 of the container box body 2 associated therewith, in particular to the protruding upper portion 16 of the frame element 14 and the open top end 3 of the container box body 2. The ribs 19 are rectilinear in the example illustrated, taking the form of ridges impressed forcibly from the sheet material from which the frame 14 is fashioned.

In particular, according to the preferred embodiment of the present invention, the stiffening ribs 19 are three elements and arranged such as to define on the frame element 14 a longitudinally delimited stiffening zone 41. The stiffening zone 41, being delimited by the stiffening ribs 19, extends longitudinally only over a part of the lower portion 17 which is located near the open top end 3 of the container box body 2, and consequently also near to the upper portion 16 protruding outwards from the container box body 2.

According to the illustrated and preferred embodiment of the present invention, the stiffening zone 41 is approximately located in the upper half of the front panel 5 of the container 2, because it is the open top end 3 of the container box body 2 and the protruding upper portion 16 of the frame element 2 which could easily buckle outwards and which would effectively cause a disturbance for the open bottom end 43 of the lid 4, and in particular the front part of the open bottom end 43, when the packet 1 has to be closed. The front part of the open bottom end 43 of the lid 4 has been formed by connecting the strengthening tab 35 to the front panel 9 along the folding line 24 (see FIG. 6) in order obtain a solid, linear and exactly defined open front edge 43 of the lid 4.

Therefore, the longitudinally delimited stiffening zone 41 is able to prevent the frame element 14 from undesirably buckling outwards, such as which would hinder an easy and correct opening and closing of the lid 4 with relation to the container box body 2. A correct closing of the lid 4 will be obtained when the open bottom end 43 of the lid 4 is positioned in alignment with the open top end 3 of the container box body 2.

Furthermore, the stiffening zone 41 is also able to prevent that the front panel 5 of the container 2 from buckling inwards, together with the front section 15 of the frame element 14, such as which would prevent a correct and concealed closing of the hinged lid 4 with relation to the container box body 2, because the open bottom end 43 of the lid 4 could not be correctly aligned, i.e. rotated in the concealed position with relation to the open top end 3 of the container box body 2, in particular in view of the front panel 5. In this case, there would remain an open gap, not illustrated, between the front panel 9 of the lid 4, on one side, and the front panel 5 of the container box body 2 together with the upper portion 16 of the front section 15, on the other side.

Of course, the ribs 19 could have a shape other than the rectilinear shape which is illustrated, for example they could be sinusoidally curvilinear, and could be impressed directly into the front panel 5 of the container box body 2 rather than into the frame element 14.

In a further embodiment, not illustrated in the drawings, the ribs 19 are dispensed with and replaced by a stiffening element rigidly associated with the inside face of the front panel 5. By way of example, an added stiffening element of the type in question could take the form of a tongue or flap (not illustrated) extending from the top end of the front panel 5, bent over and flattened against the front inside face of the container box body 2 and perhaps also exhibiting ribs similar to the ribs 19 shown in the drawings.

Figure 5:
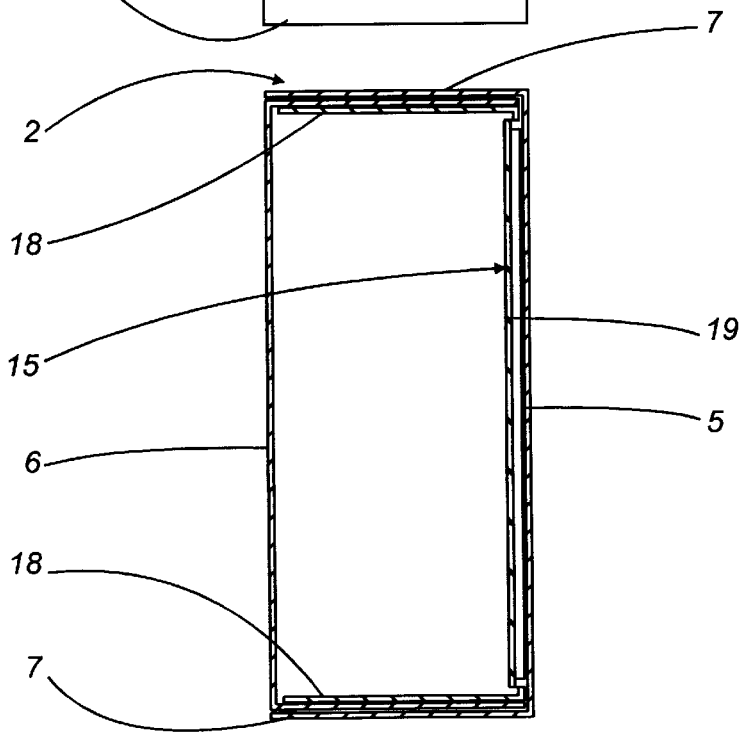
FIG. 5 illustrates schematically a transversal section of the packet of FIG. 4 according to line V—V on an enlarged scale.

As shown in FIG. 5, the incorporated part of the respective lateral portion 18 of the U-shaped frame element 14 comes in longitudinal direction, i.e. parallel to the predominating longitudinal axis 20, with its outside face only disposed in contact with an upper part of the corresponding inside face of the side panel 7 adjacent to the open top end 3 of the container box body 2. The transversal extension of the respective lateral portion 18 approximately corresponds to the transversal length of the inside face of the side panel 7, as illustrated in FIG. 5.

According to an alternative and not shown embodiment, the transversal extension of the respective lateral portion 18 is noticeably shorter than the transversal length of the inner face of the side panel 7, always considering the aforementioned desired reduction of amount of the material necessary to realize a packet. For the same reason also, the single thickness of the separate frame element 14 can be adequately reduced.

The frame element 14 comes with its stiffening zone 41 disposed in contact with the inside face of the front panel 5 of the container box body 2 only by means of the plurality of stiffening ribs 19. The stiffening zone 41 is advantageously located in a lower extension of the front section 15 in the direction of the predominating longitudinal axis 20. In consequence, as also clearly shown in the figures, there is no lateral portion 18 besides the lower extension containing the stiffening zone 41. This enables the frame element 14 to come with the outside face of its front section 15 easily and directly in contact with the inside face of an upper part of the front panel 5 adjacent to the open top end 3 of the container box body 2 ( see FIG. 5) in order to favour the concealed closing of the hinged lid 4 with relates to the open top end 3 of the front panel 5 and to the projecting portion 16 of the front section 15.

Figure 4:
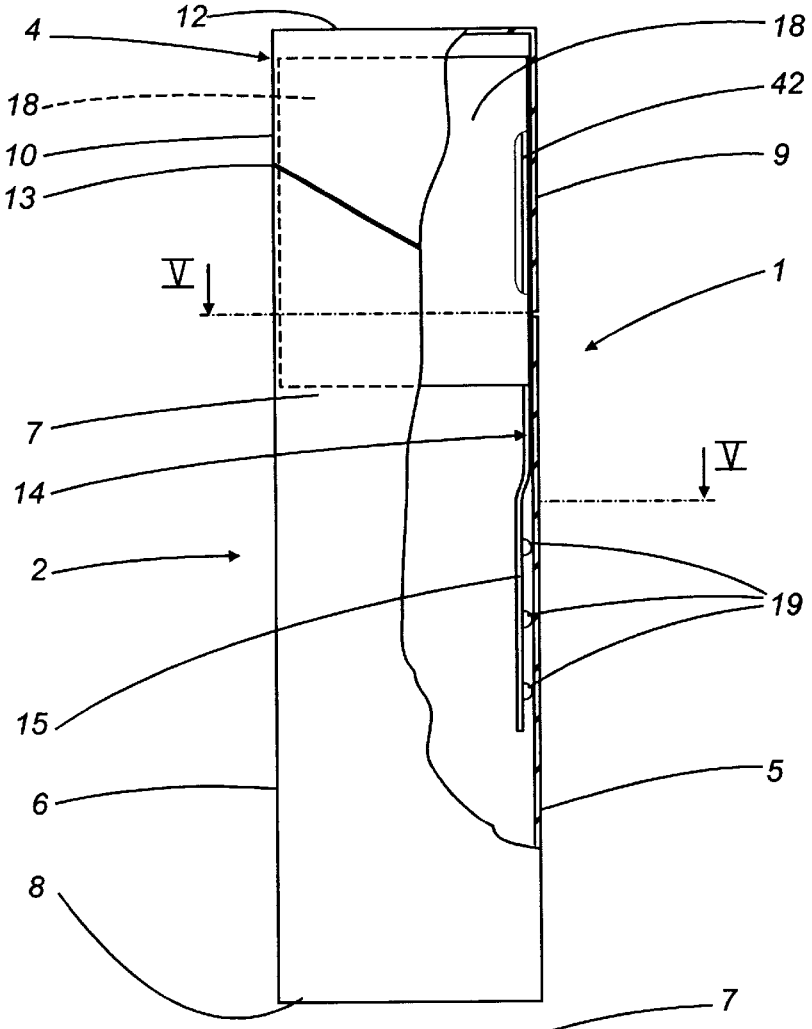
FIG. 4 illustrates a partially sectioned side view of the packet of FIG. 1 on an enlarged scale.

As illustrated in FIGS. 4 and 5, the rear panel 6 of the container box body 2, and consequently also the rear panel 10 of the lid 4, does not come into contact with the U-shaped frame element 14. Furthermore, according to the preferred embodiment as shown in FIG. 1, also the inside faces of the lower part of the front panel 5 near the bottom end panel 8 and of the two lateral panels 7 do not come into contact with the frame element 14.

Finally, it has to be considered that, according to a preferred embodiment, the frame element 14 has two wings 42 being located at the upper portion 16 near the respective folding line between the front section 15 and the lateral portion 18 (see FIG. 2). The wings 42 protrude externally from the respective lateral portions 18 in order constitute a determined frictional resistance with relation to the inside face of the corresponding flank panel 11 of the lid 4. The frictional resistance prevents, in particular a non-desired opening movement of the closed lid 4. Also, the influence of two wings 42 predisposed the front section 15 of the upper portion 16, which projects from the open top end 3 of the container box body 2, to buckle outwards. The wings 42 are preferably shaped in such a way that they are not able to cause a deformation of the front section 15 which could be able to hinder an easy and correct closing of the lid 4, but together with external influences, for example when the container box body 2 is maintained and pressed at its side panels 7, the wings 42, could be able to add the missing force capable to cause the afore-mentioned incorrect functioning of the packet 1.

According to the present invention, the front section 16 cannot buckle outwards or inwards, due to the advantageous effect of the stiffening elements 19 located in a limited stiffening zone 41 near the open top end 3 of the container box body 2.

It is particularly advantageous to provide a plurality of stiffening elements 19 in the limited stiffening zone 41 in order to obtain a possibly high stiffening effect caused by the limited zone 41 with relation to the adjacent open top end 3 of the container box body 2 and to the upper portion 16 of the front section 15.

According to a preferred embodiment, the distance between the individual stiffening elements 19 corresponds approximately to the width of two or three of the individual stiffening elements 19 (extension of a single transverse stiffening element 19 in the direction of the predominating longitudinal axis 20 as shown in FIG. 1), depending on the shape of the stiffening elements 19.

The stiffening ribs 19 provided by the lower extension of the front section 15 of the frame element 14 occupy substantially the same plane as the inside face of the front panel 5 of the container box body 2, i.e. the inside face of the front panel 5, at least in the stiffening zone 41, is preferably flat and not profiled.

The blank of the frame element 14, being an independent and constituent part of the packet 1, could be of different material and sheet thickness with relation to the blank 21 for the container box body 2 and the lid 4. The given and single thickness of the respective panels of the container box body 2 and of the frame element 14 can be sufficiently thin so that the front panel 5 of the container box body 2 and the upper portion 16 of the front section 15 would buckle outwards or inwards in absence of a stiffening zone 41 near the open top end 3 of the container box body 2 and delimited in the longitudinal direction of the packet. The present invention can advantageously be used in any type and shape of cigarette packets and the frame element can be stuck or adequately fixed on the corresponding inside face of the container. In consequence, the frame element can be solidly fixed on one or more corresponding inside faces of the container, or the same element can also be fixed in the container such as to be removable therefrom.

What is claimed is:

1. A cigarette packet, comprising:

a container box having a front panel and a rear panel which are parallel to one another; left and right side panels which are parallel to one another; and top and bottom panels which are parallel to one another; the container box being elongated along a longitudinal axis which extends in a top to bottom direction; the front and rear, left and right side, and top and bottom panels being mutually perpendicular; the front, rear, left side and right side panels extending in planes parallel to the longitudinal axis; a dividing line traversing the left side, front and right side panels, but not the rear panel, generally girthwise of container box, intermediate the top and bottom panels, so as to divide the container box into a body having an upper edge and a lid having a lower edge; the dividing line having two opposite ends; the rear panel of the container box being scored transversely thereof between the opposite ends of said dividing line, so as to provide an integral hinge to the body for rotational movement between a closed position, and an open position; the dividing line and hinge dividing respective front, rear, left side and right side panels of the container box, into respective front, rear, left side and right side panels of the body, and respective front, rear, left side and right side panels of the lid;

the left side, front and right side panels of the body, at and adjacent the upper edge being constituted by only a single thickness of stock material, substantially completely throughout;

a frame element comprising a front panel having a lower portion and an upper portion; the lower portion being substantially shorter in a direction parallel to the longitudinal axis, than is the front panel of the body;

the frame element being partially received within the body and mounted therein, such that the lower portion of the front panel of the frame element is disposed facewise against the front panel of the body, below the upper edge of the body, and the upper portion of the front panel of the frame element extends above the upper edge of the body, so as to protrude upwards into the lid for facewise juxtaposition with the front panel of said lid, when the lid is disposed in the closed position thereof;

a plurality of transversely extending stiffening elements, spaced from one another in a direction along the longitudinal axis; the stiffening elements being provided substantially only within an area of the container box in which the front panel of the body is backed by said lower portion of the front panel of the frame element; and said front panel of said frame element being distant from said front panel of said body within said area of said stiffening elements, and adjacent said upper edge and within an area having no stiffening elements, said frame element being in direct contact with said body.

2. The cigarette packet of claim 1, wherein:

said container box is made from a first blank and said frame is made from a second blank, which is separate from said first blank.

3. The cigarette packet of claim 2, wherein:

said frame element further includes a left side panel and a right side panel, respectively flanking said front panel thereof, such that said frame element is of squared U-shape in top plan view; said left and right side panels of said frame element having lower portions respectively disposed facewise against said left and right side panels of said body, within said body.

4. The cigarette packet of claim 3, wherein:

said stiffening elements are located in said lower portion of said front panel of said frame element and are disposed in contact with said front panel of said body, within said body.

5. The cigarette packet of claim 1, wherein:

said stiffening elements are provided as ridges impressed in said lower portion of said front panel of said frame element.

6. The cigarette packet of claim 1, wherein:

said stiffening elements are provided as ridges impressed in said front panel of said body.

* * * * *